US005226389A

United States Patent [19]

Buuck

[11] Patent Number: 5,226,389

[45] Date of Patent: Jul. 13, 1993

[54] DIRECT ACTING TAPPET

[75] Inventor: Bryce A. Buuck, Bellevue, Mich.

[73] Assignee: Eaton Corporation, Cleveland, Ohio

[21] Appl. No.: 971,136

[22] Filed: Nov. 4, 1992

[51] Int. Cl.[5] ..... F01L 1/14

[52] U.S. Cl. ..... 123/90.48; 123/90.51; 123/90.28; 74/569

[58] Field of Search ..... 123/90.48, 90.49, 90.51, 123/90.52, 90.28; 74/569

[56] References Cited

U.S. PATENT DOCUMENTS

| | | | |
|---|---|---|---|
| 2,817,326 | 12/1957 | Taylor | 123/188.1 |
| 3,431,896 | 3/1969 | Giulietti | 123/90.51 |
| 3,818,879 | 6/1974 | Line | 123/90.54 |
| 3,989,016 | 11/1976 | Morgan | 123/90.51 |
| 4,430,970 | 2/1984 | Holtzberg et al. | 123/90.51 |
| 4,590,898 | 5/1986 | Buente et al. | 123/90.55 |
| 4,615,440 | 10/1986 | Downing | 123/90.48 |
| 4,638,772 | 1/1987 | Burandt | 123/90.48 |
| 4,805,567 | 2/1989 | Heimburg | 123/90.28 |
| 4,829,950 | 5/1989 | Kanamaru et al. | 123/90.51 |
| 4,876,996 | 10/1989 | Mayer et al. | 123/90.51 |
| 4,909,198 | 3/1990 | Shiraya et al. | 123/90.51 |
| 5,070,827 | 12/1991 | Krieg et al. | 123/90.51 |
| 5,081,976 | 1/1992 | Dahm et al. | 123/90.48 |
| 5,129,372 | 7/1992 | Seiberth et al. | 123/90.51 |
| 5,148,779 | 9/1992 | Okuse et al. | 123/90.28 |

FOREIGN PATENT DOCUMENTS

| | | | |
|---|---|---|---|
| 185913 | 10/1983 | Japan | 123/90.51 |
| 210308 | 12/1983 | Japan | 123/90.51 |

*Primary Examiner*—Willis R. Wolfe
*Assistant Examiner*—Weilun Lo
*Attorney, Agent, or Firm*—F. M. Sajovec

[57] ABSTRACT

A non-hydraulic direct acting tappet in the form of a cup-shaped body and a replaceable, cylindrical insert retained within a support formed inside the body. In a preferred embodiment, the support is in the form of a cylindrical boss formed on the inner end wall of the body and the insert is retained by press fitting. In other embodiments, the insert is retained by an O-ring on the insert, the boss and insert are of a non-circular shape, or the boss is on an axis offset from the longitudinal axis of the body.

9 Claims, 2 Drawing Sheets

DIRECT ACTING TAPPET

The present invention relates generally to valve lifters for internal combustion engines, and more specifically to valve lifters of the direct acting type, which are commonly referred to as "bucket tappets".

In the development of high performance, fuel efficient internal combustion engines, the type wherein the valve gear thereof includes one or two overhead camshafts per cylinder bank and wherein the cam lobes act directly on a lash adjuster interposed between the camshaft and the engine valve stem, has become very popular. Early versions of such engines employed mechanical bucket tappets wherein the required operating lash between the cam lobe and the valve was initially set by the use of disks of varying thicknesses placed between the outer end face of the bucket structure and the cam lobe or between the inner end face and the valve stem. Adjustment for wear to maintain the specified lash was accomplished by replacing an existing disk with one of greater thickness. An example of a tappet using replaceable disks is shown in U.S. Pat. No. 3,431,896 to Giulietti. Screw-adjustable mechanical bucket tappets were also developed, as shown by U.S. Pat. No. 3,818,879 to Line.

As the development of such engines continued, mechanical bucket tappets were essentially universally replaced by hydraulic bucket tappets of the type shown in U.S. Pat. No. 4,590,898 to Buente et al.

In recent years, more and more emphasis is being placed on valve train components of extremely light weight, which has resulted in renewed interest in mechanical bucket tappets. While mechanical tappets of the type disclosed in U.S. Pat. No. 3,431,896 are inherently light, the requirement for a replaceable disk at the camshaft contact interface reduces the available cam contact diameter of the tappet.

An example of a mechanical bucket tappet which meets most of the above needs is that shown in U.S. Pat. No. 4,909,198 to Shiraya et al. This tappet has an Al-Si body, and Fe-C type sprayed coating on the cylindrical wall of the body, a wear resistant chip fixed to the underside of the face of the body in contact with the valve stem and an adjusting shim on the outer face surface in contact with the cam. Other light weight mechanical bucket tappets are shown in U.S. Pat. No. 4,430,970 to Holtzberg et al which includes a polymeric body and a metallic, cam-engaging shim; and U.S. Pat. No. 4,829,950 to Kanamaru et al which discloses a one-piece metallic body with a loose cap between the valve tip and the tappet body.

The above tappets, although being of relatively light weight, are either quite expensive to manufacture, include expensive materials, or include un-retained cam or valve stem contacting elements, the latter making it difficult for a tappet supplier to provide an integral unit for an engine manufacturer to install in an engine. While attempts have been made to provide a retained contact member, such as that shown in U.S. Pat. No. 2,817,326 to Taylor, these require a separate, fabricated retaining member which add weight and cost.

Considering the above, it is an object of the present invention to provide a mechanical direct acting tappet which is very light in weight, is inexpensive to manufacture and which includes a valve stem contacting element of selective length including means to retain the contacting element within the body of the tappet, and which can be easily ejected from the body when it is to be exchanged for an element of a different length. In accordance with another embodiment of the invention, a hydraulic direct acting tappet can be converted to a mechanical tappet by replacing the hydraulic element of an existing hydraulic design with a valve stem contacting element in accordance with the invention.

To meet the above objectives, the present invention provides a cup-shaped tappet body which can be fabricated by a number of different processes, but preferably by a cold forming process and which has a cylindrical boss formed on the inside of the cam contacting face of the body and a cylindrical valve stem engaging member press fit into the boss. In another embodiment, the valve stem contacting element is in close-fitting sliding engagement with the inside diameter of the boss and retained therein by means of an O-ring or the like received in an annular groove formed in the outer diameter of the valve stem contacting element.

Also provided are air expulsion means to facilitate insertion of the valve stem contacting element in the form of an axial groove formed in the inside diameter of the cylindrical boss, or in the form of a hole formed through the top of the tappet body and opening into the interior of the cylindrical boss.

The invention further provides an embodiment wherein the valve stem contacting element is elongated and is received within the web and hub structure of the body of a well-known hydraulic tappet and which replaces the hydraulic element thereof.

Other objectives and advantages of the invention will be apparent from the following description when considered in connection with the accompanying drawings wherein.

Figure 1:
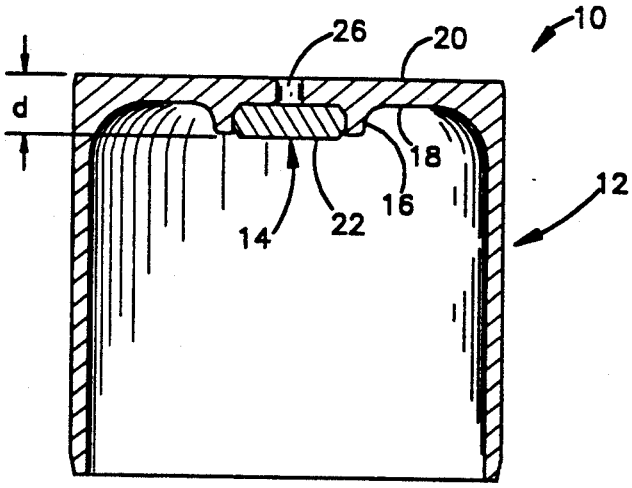
FIG. 1 is a sectional view of a preferred embodiment of the invention.
Figure 2:
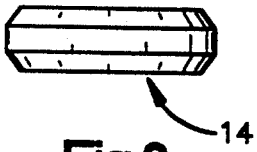
FIG. 2 is an enlarged elevation view of an element of the embodiment of FIG. 1.

Referring to FIG. 1, there is shown a mechanical bucket tappet 10 comprising a cup-shaped body 12 and a cylindrical insert 14 received in a tubular boss 16 protruding from the inner face 18 of the body. As is well known in the art, the outer face 20 of the body is contacted directly by a cam of an internal combustion engine, while the tip of the stem of a poppet valve of the engine is contacted by a surface of the tappet which is defined in the illustrative embodiment by the end surface 22 of the insert 14. In the preferred embodiment, the insert 14 is formed as a relatively thin disk as shown in FIG. 2 and is press fit into the boss 16. To provide means to expel air to facilitate assembly and to facilitate replacement of the insert, a hole 26 is formed through the face 20.

As is well known in the art, in a mechanical valve train a certain amount of lash or clearance must be maintained. In direct acting valve gear in which bucket tappets are employed, the desired lash is obtained by setting the distance "d", as shown in FIG. 1, between the cam contacting surface of the tappet and the valve stem contacting surface, which is equal to the distance between the base circle of the cam and the valve tip when the valve is closed plus the desired lash. Because of tolerance stack-ups within the engine, however, the distance between the cam and the valve is not consistent from valve to valve in any given engine; therefore, it is necessary to vary the distance "d" at the time of assembly. In accordance with the present invention, this is accomplished by providing inserts of different lengths such that at engine assembly a tappet assembly with the proper size insert can be selected to obtain the desired lash.

Figure 3:
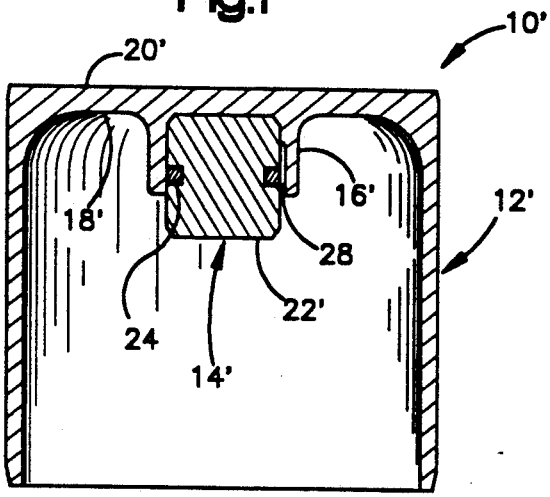
FIG. 3 is a cross-sectional view of a first alternative embodiment of the invention.
Figure 4:
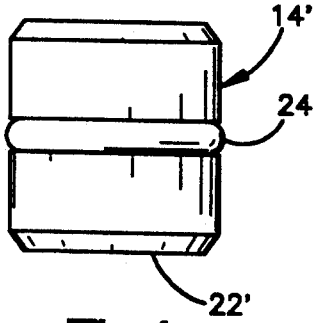
FIG. 4 is an enlarged elevation view of an element of the embodiment of FIG. 3.
Figure 5:
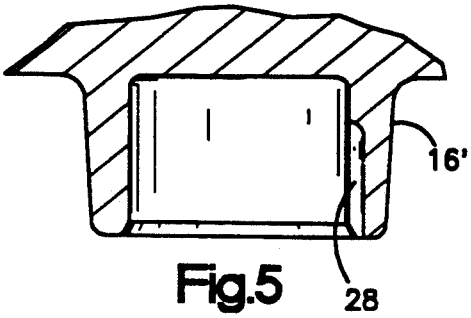
FIG. 5 is an enlarged, fragmentary sectional view of a portion of the embodiment of FIG. 3.

In accordance with an alternative embodiment of the invention as shown in FIGS. 3 and 4, the body 12' is similar to that shown in FIG. 1, but with a longer boss 16'. In this embodiment, the valve-contacting insert 14' is a close sliding fit within the boss 16' and is retained therein by means of an O-ring 24 or the like received in an annular groove formed in the insert. It will be noted that after assembly in an engine, the parts will be retained by the cam and valve stem so that retention of the insert in all embodiments herein is necessary only for the purpose of maintaining the integrity of the assembly during transport and handling of the tappet prior to the installation of the tappet in an engine in order to avoid loose pieces and thus simplify assembly. It is also clear that the O-ring or other retainer can also be received in a groove formed inside the boss 16. To provide means to expel the air to facilitate assembly in the FIG. 3 embodiment, an axial groove 28 is formed on the inside of the boss 16 as best shown in FIG. 5.

Figure 6:
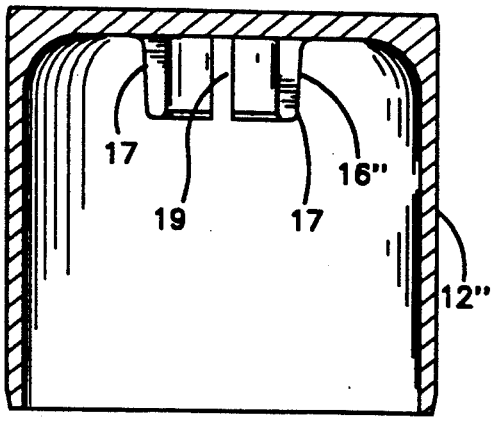
FIG. 6 is a sectional view of a second alternative embodiment of the invention.

Referring to FIG. 6, there is shown an alternative embodiment of the body designated 12" wherein the boss 16" is formed as four arcuate lugs 17 separated by slots 19. An insert 14 such as that shown in FIG. 2 can be pressed into the cavity defined by the lugs, or an insert 14' such as that shown in FIG. 4, including a retainer 24, can be received in sliding engagement with the inner surfaces of the lugs.

Figure 7:
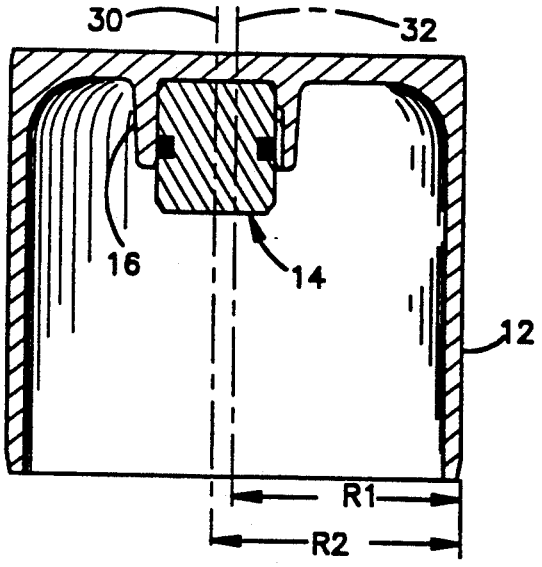
FIG. 7 is a sectional view of a third alternative embodiment of the invention.
Figure 8:
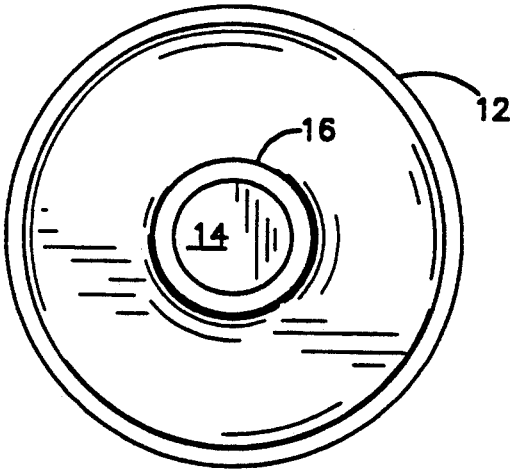
FIG. 8 is a bottom plan view of a fourth alternative embodiment of the invention.

To avoid wear, it is important that the insert 14 does not rotate within the boss 16. In the FIG. 1 construction this is accomplished by the press fit of the insert in the boss, while in the FIG. 3 construction the friction between the O-ring 24 and the boss inhibits rotation. It is possible, however, that in certain applications it may be necessary to provide more positive anti-rotation can be accomplished by offsetting the axis 30 of the boss 16 from the axis 32 of the body 12 as shown in exaggerated form in FIG. 7, or by making the boss and insert a shape in section which is other than round as shown in exaggerated form in FIG. 8. In actual practice, the offset in the FIG. 7 embodiment and the out-of-roundness in the FIG. 8 embodiment would only need to be an amount which will insure that using normal machining tolerances, an aligned (FIG. 7) or a round (FIG. 8) condition cannot occur. For example, if the radius $R_1$ in FIG. 7 is 15 mm±0.25 mm, then the radius $R_2$ needs only to be greater than 15.5 mm±0.25 mm.

Figure 9:
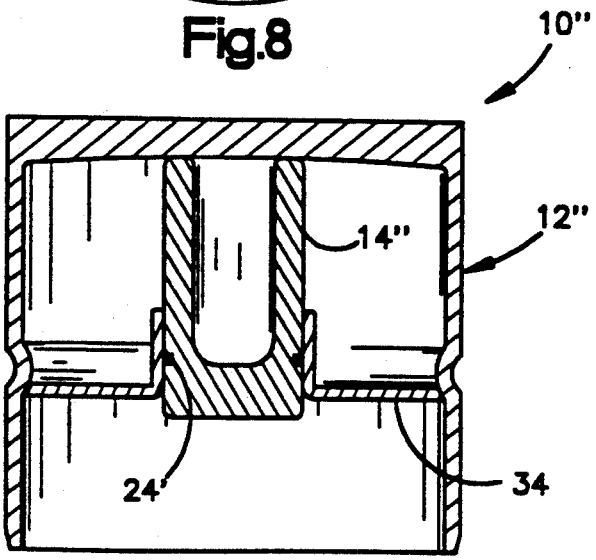
FIG. 9 is a sectional view of a fifth alternative embodiment of the invention.

Referring to FIG. 9, there is shown a further embodiment of the invention, wherein the invention is adapted for use in converting a hydraulic tappet such as that disclosed in U.S. Pat. No. 4,590,898, to a mechanical one. In that embodiment, the body assembly comprising a body 12" and a web and hub element 34 of the hydraulic tappet are retained, and an elongated insert 14" is inserted into the web and hub element and is retained therein by a retaining member such as O-ring 24'.

In addition to the advantages resulting form the retention aspects of the invention, several other advantages can be appreciated. The boss (e.g. element 16 in FIG. 1) adds stiffness to the central area of the cam contacting surface of the tappet body. Also the elimination of external disks and the need to provide radial retention for them on the tappet body enables the full diameter of the tappet body to be available as the cam contacting surface.

In the practice of the invention in an engine assembly process, the clearance between the cam at its base circle and the tip of the valve is measured for every valve in the engine. Then an insert 14 is selected which when assembled into a body 12 will result in a distance d as shown in FIG. 1, which distance represents the clearance between the cam and the valve tip plus the desired lash. It is expected that using present day automation technology, the entire sequence of measurement, calculation, selection and assembly steps can be completely automated.

I claim:

1. A non-hydraulic direct acting valve lifter comprising a one piece cup-shaped body having a cam contacting surface formed on the outer face of the closed end thereof and cylindrical support means formed on the inner face of the closed end thereof, said cylindrical support means having a longitudinal axis parallel to the longitudinal axis of said body; a cylindrical insert received in interference fit in said support means; and means for expelling air between said insert and said support means to facilitate insertion of said insert into said support means.

2. Apparatus as claimed in claim 1, in which said cylindrical support means is defined by a cylindrical boss.

3. Apparatus as claimed in claim 2, including an axial groove formed on the inner wall of said boss.

4. Apparatus as claimed in claim 2, including a hole formed through the closed end of said body and opening into the interior of said boss.

5. Apparatus as claimed in claim 2, in which said boss and said insert are circular in section.

6. Apparatus as claimed in claim 2, in which said boss and said insert are non-circular in section.

7. Apparatus as claimed in claim 1, in which said cylindrical support means is defined by a plurality of arcuate lugs.

8. Apparatus as claimed in any one of claims 1-7, in which a retaining ring is received between said insert and said cylindrical support means, said interference fit being between said retaining ring and said cylindrical support means.

9. Apparatus as claimed in any one of claims 1-7, in which the longitudinal axis of said cylindrical support means is offset from the longitudinal axis of said body.

* * * * *